US010537000B2

(12) United States Patent
Ren et al.

(10) Patent No.: US 10,537,000 B2
(45) Date of Patent: Jan. 14, 2020

(54) CONTROLLER, LIGHT SOURCE DRIVING CIRCUIT AND METHOD FOR CONTROLLING LIGHT SOURCE MODULE

(71) Applicant: O2Micro, Inc., Santa Clara, CA (US)

(72) Inventors: Zhimou Ren, Chengdu (CN); Yanjun Li, Shanghai (CN); Binqiang Li, Shanghai (CN); Zhenqiu Hu, Shanghai (CN)

(73) Assignee: O2Micro Inc., Santa Clara, CA (US)

( * ) Notice: Subject to any disclaimer, the term of this patent is extended or adjusted under 35 U.S.C. 154(b) by 0 days.

(21) Appl. No.: 16/374,435

(22) Filed: Apr. 3, 2019

(65) Prior Publication Data

US 2019/0327805 A1 Oct. 24, 2019

(30) Foreign Application Priority Data

Apr. 18, 2018 (CN) ..... 2018 1 0351017

(51) Int. Cl.
*H05B 37/02* (2006.01)
*H05B 33/08* (2006.01)

(52) U.S. Cl.
CPC ..... *H05B 33/0815* (2013.01); *H05B 33/089* (2013.01); *H05B 33/0887* (2013.01); *H05B 37/0281* (2013.01); *H05B 33/0842* (2013.01); *H05B 33/0851* (2013.01); *H05B 33/0884* (2013.01)

(58) Field of Classification Search
CPC ..... H05B 33/0884; H05B 33/0842; H05B 33/0851
USPC ..... 315/291, 308
See application file for complete search history.

(56) References Cited

U.S. PATENT DOCUMENTS

| | | | | |
|---|---|---|---|---|
| 10,076,011 | B1 * | 9/2018 | Amidi | H05B 33/0857 |
| 2015/0181668 | A1 * | 6/2015 | Chang | H05B 33/0842 315/294 |
| 2016/0088697 | A1 * | 3/2016 | Yan | H05B 33/0818 315/205 |
| 2016/0212815 | A1 * | 7/2016 | Watanabe | H05B 33/0845 |

* cited by examiner

*Primary Examiner* — Thuy V Tran

(57) ABSTRACT

A controller includes a current input terminal, a switch monitoring terminal, a first control terminal, a second control terminal and a current monitoring terminal. The current input terminal is coupled to a power source through a rectifier and receives electric power from the power source. The switch monitoring terminal is coupled to a power switch and receives a switch monitoring signal indicating the on/off state of the power switch. The power switch is coupled between the rectifier and the power source. Based on the switch monitoring signal, the first control terminal turns on or turns off a first light source in a light source module and the second control terminal turns on or turns off a second light source in the light source module. The current monitoring terminal monitors a current flowing through the first light source and a current flowing through the second light source.

20 Claims, 9 Drawing Sheets

CONTROLLER, LIGHT SOURCE DRIVING CIRCUIT AND METHOD FOR CONTROLLING LIGHT SOURCE MODULE

RELATED APPLICATION

This application claims priority to Chinese Patent Application No. 201810351017.X, titled "Controller, Light Source Driving Circuit and Method for Controlling Light Source Module," filed on Apr. 18, 2018, with the National intellectual Property Administration of the People's Republic of China (CNIPA),

BACKGROUND

Compared with traditional incandescent lamps, light-emitting diode (LED) light sources offer several advantages such as low power conservation, environmental friendliness, high power efficiency, and long lifespan. Therefore, there is a trend to replace incandescent lamps with LED light sources. An LED bulb is one type of LED lamp. The LED bulb has a shape and size similar to traditional incandescent lamps. LED light sources and control chips are integrated within an LED bulb. A conventional LED light source driving circuit includes two control chips, where one is operable for regulating the brightness of the light source and the other is operable for regulating the color of the light source. Because the conventional LED light source driving circuit uses two individual control chips, the cost of manufacturing is increased.

SUMMARY

Embodiments in accordance with the present invention provide a controller, a light source driving circuit and a method for controlling a light source module.

In one embodiment, a controller for controlling a light source module includes a current input terminal, a switch monitoring terminal, a first control terminal, a second control terminal and a current monitoring terminal. The current input terminal is coupled to a power source through a rectifier and is operable for receiving electric power from the power source. The switch monitoring terminal is coupled to a power switch and is operable for receiving a switch monitoring signal indicating the on/off state of the power switch. The power switch is coupled between the rectifier and the power source. The first control terminal is operable for turning on or turning off a first light source in the light source module based on the switch monitoring signal. The second control terminal is operable for turning on or turning off a second light source in the light source module based on the switch monitoring signal. The current monitoring terminal is operable for monitoring a current flowing through the first light source and a current flowing through the second light source.

In one embodiment, a light source driving circuit includes a light source module and a controller. The light source module includes a first light source and a second light source. The controller is coupled to the light source module and is operable for receiving electric power from a power source through a rectifier to power the light source module. The controller includes a memory module. The controller is operable for generating a first control signal to turn on or turn off the first light source based on data stored in the memory module, and generating a second control signal to turn on or turn off the second light source based on data stored in the memory module.

In yet another embodiment, a method for controlling a light source module that includes a first light source and a second light source includes the following steps: receiving electric power from a power source, to power the light source module via the controller; reading data stored in a memory module; and generating a first control signal by the controller, based on data stored in the memory module to turn on or turn off the first light source; and generating a second control signal by the controller, based on data stored in the memory module to turn on or turn off the second light source.

BRIEF DESCRIPTION OF THE DRAWINGS

Features and advantages of embodiments of the claimed subject matter will become apparent as the following detailed description proceeds, and upon reference to the drawings, wherein like numerals depict like parts, and in which:

DETAILED DESCRIPTION

Reference will now be made in detail to the embodiments of the present invention. While the invention will be described in combination with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Some portions of the detailed descriptions that follow are presented in terms of procedures, logic blocks, processing, and other symbolic representations of operations on data bits within a computer memory. These descriptions and representations are the means used by those skilled in the data processing arts to most effectively convey the substance of their work to others skilled in the art. In the present application, a procedure, logic block, process, or the like, is conceived to be a self-consistent sequence of steps or instructions leading to a desired result. The steps are those utilizing physical manipulations of physical quantities. Usually, although not necessarily, these quantities take the form of electrical or magnetic signals capable of being stored, transferred, combined, compared, and otherwise manipulated in a computing system. It has proven convenient at times, principally for reasons of common usage, to refer to these signals as transactions, bits, values, elements, symbols, characters, samples, pixels, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present disclosure, discussions utilizing terms such as "receiving," "calculating," "recording," "reading," "acquiring," "selecting," "determining," "increasing," "decreasing," "receiving," "generating," updating," "writing," or the like, refer to actions and processes of a controller or computing system or similar electronic computing device or processor. A controller or computing system or similar electronic computing device manipulates and transforms data represented as physical (electronic) quantities within the computing system memories, registers or other such information storage, transmission or display devices.

Figure 1:
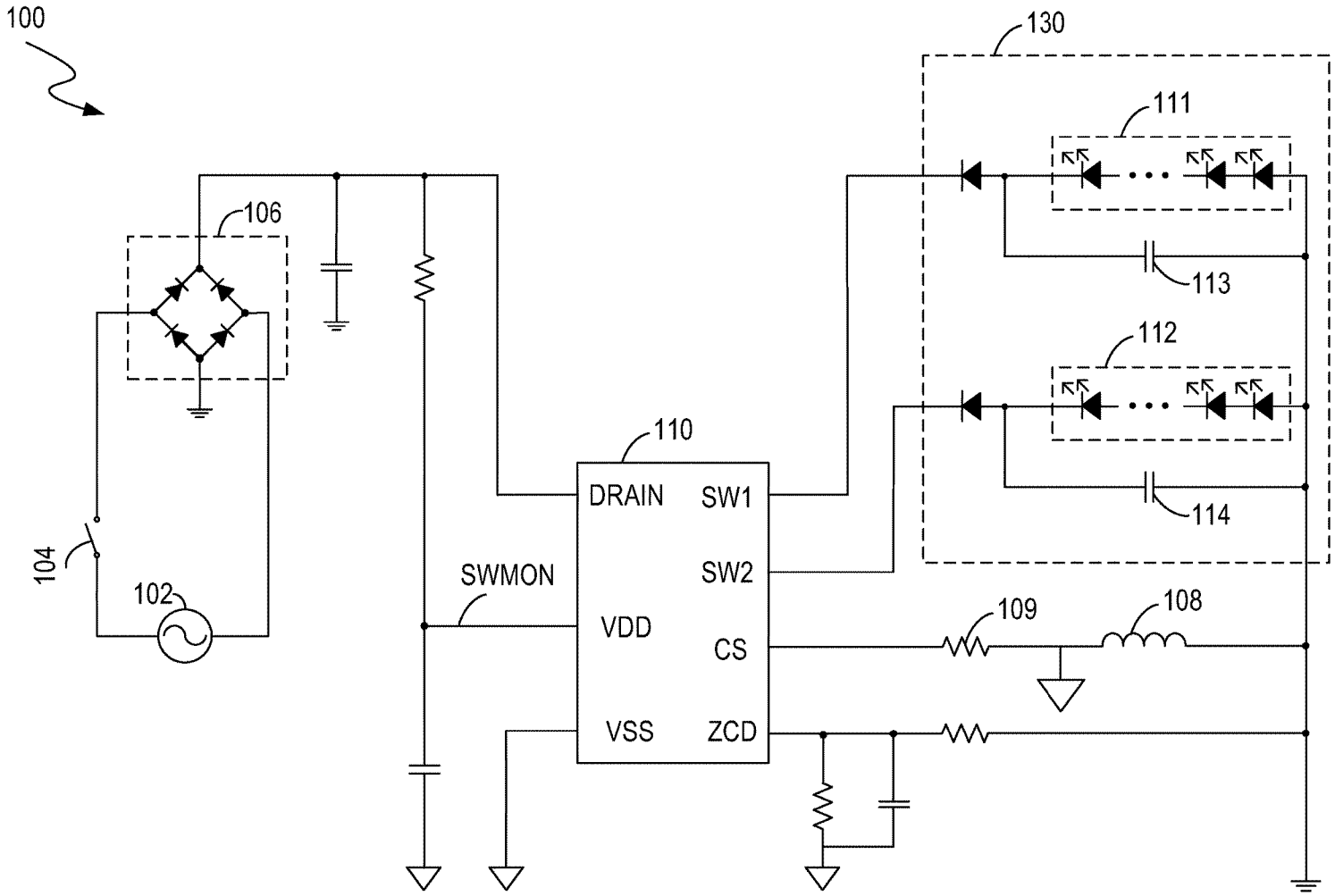
FIG. 1 shows a light source driving circuit, in accordance with one embodiment of the present invention.

FIG. 1 shows a light source driving circuit 100, in accordance with one embodiment of the present invention. The light source driving circuit 100 includes a light source module 130. The light source module 130 includes a first light source 111 and a second light source 112. A capacitor 113 is coupled in parallel with the first light source 111, and a capacitor 114 is coupled in parallel with the second light source 112. In one embodiment, the first light source 111 and the second light source 112 are LED strings with different color temperatures. In another embodiment, the first light source 111 and the second light source 112 are LED strings with different brightnesses. The light source module 130 can have different modes when it is turned on according to the on/off state of the first light source 111 and the second light source 112. For example, when turned on, the light source module 130 can be in mode A, mode B or mode C, where mode A is a default mode. In mode A, the first light source 111 is turned on and the second light source 112 is turned off. In mode B, both the first light source 111 and the second light source 112 are turned on. In mode C, the first light source 111 is turned off and the second light source 112 is turned on.

The light source driving circuit 100 further includes a controller 110. The controller 110 is coupled to the light source module 130, receives electric power from a power source 102 through a rectifier 106, and supplies electric power to the light source module 130. The controller 110 includes a memory module (shown in FIG. 3). The controller 110 generates a first control signal to turn on or turn off the first light source 111, and generates a second control signal to turn on or turn off the second light source 112, based on data stored in the memory module to switch the mode of the light source module 130.

The terminals of the controller 110 include a current input terminal DRAIN, a switch monitoring terminal VDD, a first control terminal SW1, a second control terminal SW2 and a current monitoring terminal CS. The current input terminal DRAIN is coupled to the power source 102 through the rectifier 106 and receives electric power from the power source 102. The switch monitoring terminal VDD is coupled to a power switch 104 and is operable for receiving a switch monitoring signal SWMON that indicates the on/off state of the power switch 104. In one embodiment, the switch monitoring signal SWMON is the voltage at the switch monitoring terminal VDD. The switch monitoring terminal VDD also acts as the power terminal of the controller 110 and receives electric power from the power source 102. The power switch 104 is coupled between the rectifier 106 and the power source 102. The first control terminal SW1 is coupled to the first light source 111 and is operable for turning on or turning off the first light source 111 based on the switch monitoring signal SWMON. The second control terminal SW2 is coupled to the second light source 112 and is operable for turning on or turning off the second light source 112 based on the switch monitoring signal SWMON. The current monitoring terminal CS is coupled to the light source module 130 through a resistor 109 and an inductor 108, and is operable for monitoring a current flowing through the first light source 111 and a current flowing through the second light source 112.

Figure 2:
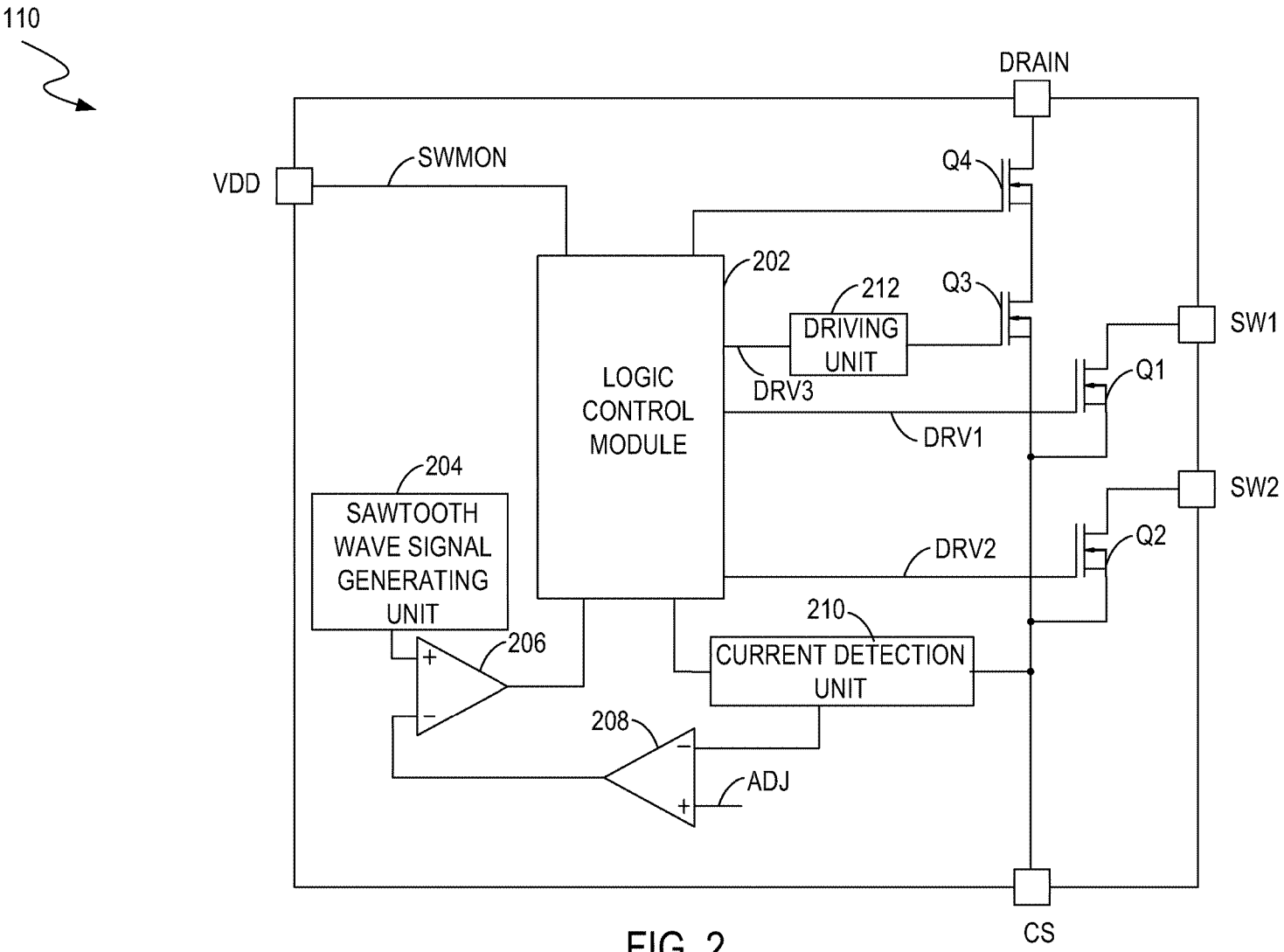
FIG. 2 shows a controller, in accordance with one embodiment of the present invention.

FIG. 2 shows a controller 110 in accordance with one embodiment of the present invention. FIG. 2 will be described in combination with FIG. 1. The controller 110 includes a first switch Q1 coupled to the first control terminal SW1, a second switch Q2 coupled to the second control terminal SW2, a third switch Q3 coupled to the current input terminal DRAIN, a fourth switch Q4 coupled between the third switch Q3 and the current input terminal DRAIN, and a logic control module 202 coupled to the first switch Q1, the second switch Q2, the third switch Q3 and the fourth switch Q4. The state of the fourth switch Q4 is determined by the third switch Q3. If the third switch Q3 is on, the fourth switch Q4 is on; and if the third switch Q3 is off, the fourth switch Q4 is off. The logic control module 202 updates data stored in the memory module (shown in FIG. 3) based on the switch monitoring signal SWMON, and generates a first control signal DRV1 and a second control signal DRV2 based on data stored in the memory module. The first control signal DRV1 controls the first switch Q1 to turn on or turn off the first light source 111. The second control signal DRV2 controls the second switch Q2 to turn on or turn off the second light source 112. The logic control module 202 controls the third switch Q3 using a third control signal DRV3 to regulate the total current of the light source module 130. The controller 110 also includes a current detection unit 210, an error amplifier 208, a sawtooth wave signal generating unit 204 and a comparator 206.

Specifically, the current detection unit 210 is coupled to the current monitoring terminal CS, detects a current flowing through the first light source 111, and detects a current flowing through the second light source 112 (e.g., a current flowing through the first switch Q1 and/or a current flowing through the second switch Q2). If the first switch Q1 is on, the current detection unit 210 detects a current flowing through the first switch Q1. If the second switch Q2 is on, the current detection unit 210 detects a current flowing through the second switch Q2. If the first switch Q1 and the second switch Q2 are both on, the current detection unit 210 detects a sum of the current flowing through the first switch Q1 and the current flowing through the second switch Q2. The error amplifier 208 compares an output signal of the current detection unit 210 with a preset reference signal ADJ, and outputs an error signal to the comparator 206. The comparator 206 compares the error signal with a sawtooth wave signal output from the sawtooth wave signal generating unit 204, and outputs a comparison result to the logic control module 202. The logic control module 202 generates the third control signal DRV3 based on the comparison result, and controls the duty cycle of the third switch Q3 via a driving unit 212, thereby regulating the total current of the light source module 130.

If the third switch Q3 is on, then the fourth switch Q4 is also on, and a current from the power source 102 flows from the current input terminal DRAIN through the fourth switch Q4, the third switch Q3, the current monitoring terminal CS, the resistor 109 and the inductor 108, to ground. During this period, the inductor 108 stores electric power. If the third switch Q3 is off and the first switch Q1 is on, then the inductor 108 discharges, and a current flows from one end of the inductor 108 through the first light source 111, the first control terminal SW1, the first switch Q1, and the current monitoring terminal CS to the other end of the inductor 108. If the third switch Q3 is off and the second switch Q2 is on, the inductor 108 discharges, and a current flows from one end of the inductor 108 through the second light source 112, the second control terminal SW2, the second switch Q2, and the current monitoring terminal CS to the other end of the inductor 108.

Figure 3:
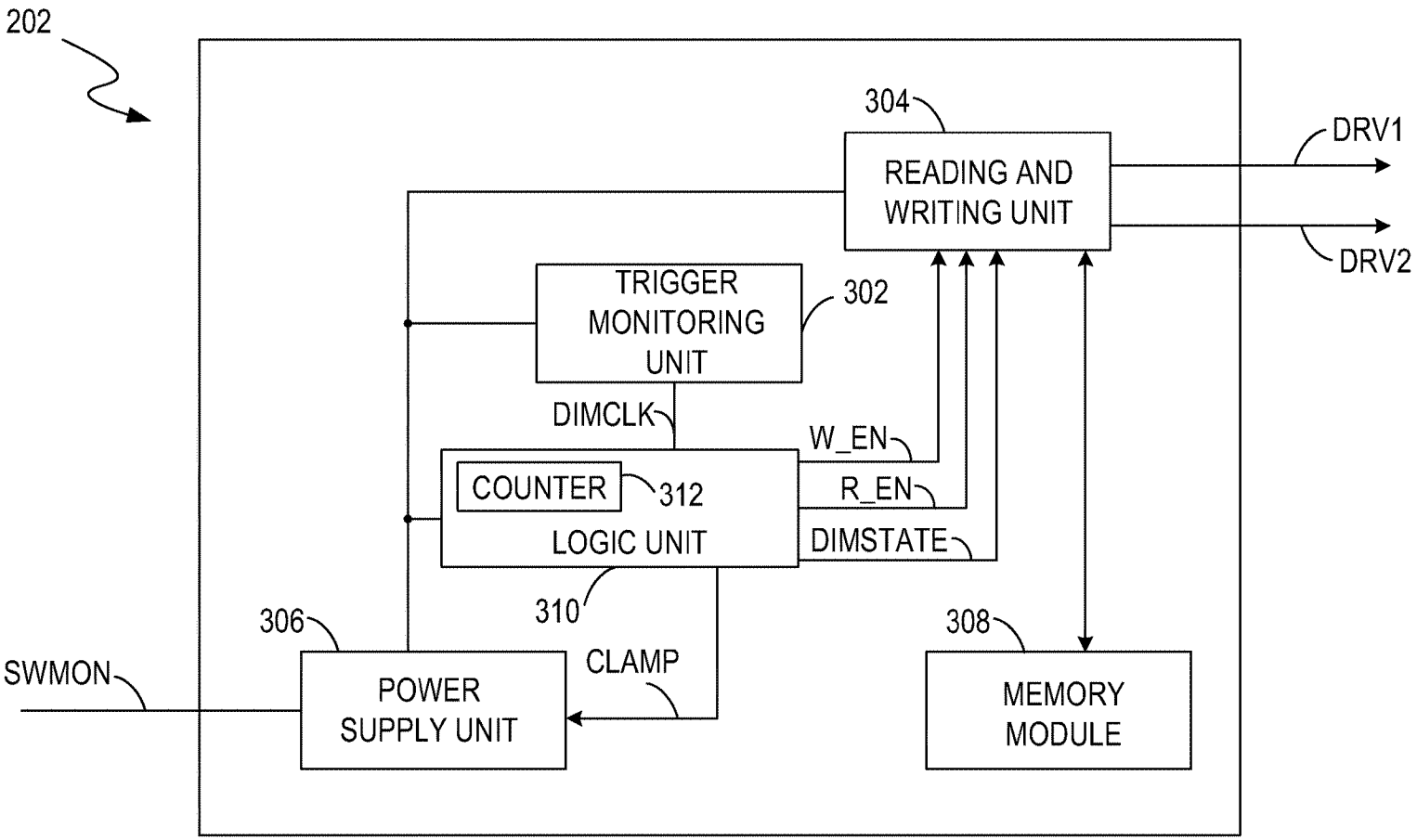
FIG. 3 shows a logic control module, in accordance with one embodiment of the present invention.

FIG. 3 shows a logic control module 202 in accordance with one embodiment of the present invention. The logic control module 202 includes a trigger monitoring unit 302, a logic unit 310, a memory module 308, a reading and writing unit 304, and a power supply unit 306.

With reference also to FIG. 1, the power supply unit 306 receives electric power from the power source 102 from the switch monitoring signal SWMON, and powers each component in the controller 110. The trigger monitoring unit 302 is operable for generating a trigger signal DIMCLK according to the switch monitoring signal SWMON. In one embodiment, when the power switch 104 is off, a negative pulse appears in the trigger signal DIMCLK. The logic unit 310 is operable for generating a read enable signal R_EN and a write enable signal W_EN according to the switch monitoring signal SWMON, and for generating a regulating signal DIMSTATE according to the trigger signal DIMCLK. The reading and writing unit 304 is operable for writing to the memory module 308 in response to the write enable signal WEN and the regulating signal DIMSTATE, and for reading the memory module 308 based on the read enable signal R_EN. Furthermore, the reading and writing unit 304 also generates the first control signal DRV1 and the second control signal DRV2 based on the data read from the memory module 308. The first control signal DRV1 and the second control signal DRV2 are used to control the on/off state of the first light source 111 and the second light source 112.

The logic unit 310 includes a counter 312 operable for storing a count value. The counter 312 updates the count value based on the trigger signal DIMCLK. In one embodiment, the count value increases by one in response to each negative pulse in the trigger signal DIMCLK.

Specifically, when the power switch 104 is turned on, the voltage at the switch monitoring terminal VDD increases. When the voltage at the switch monitoring terminal VDD increases to a first voltage V1, the power supply unit 306 provides a voltage greater than a write threshold $V_{W\text{-}TH}$ (e.g., the first voltage V1) to allow the reading and writing unit 304 to write to the memory module 308. If the voltage at the switch monitoring terminal VDD increases to the first voltage V1, the logic unit 310 outputs the write enable signal W_EN in a first state (e.g., at a high level) at time $t_W$. If the regulating signal DIMSTATE is also in the first state (e.g., at a high level), then the reading and writing unit 304 writes the count value of the counter 312 to the memory module 308. At time $t_R$, which is later than time $t_W$, the logic unit 310 outputs the read enable signal R_EN in a first state (e.g., at a high level), and the reading and writing unit 304 reads the data from the memory module 308 to generate the first control signal DRV1 and the second control signal DRV2. In one embodiment, if the first control signal DRV1 is in the first state (e.g., at a high level), then the first switch Q1 is on and the first light source 111 is turned on; if the first control signal DRV1 is in a second state (e.g., at a low level), then the first switch Q1 is off and the first light source 111 is turned off. If the second control signal DRV2 is in the first state (e.g., at a high level), then the second switch Q2 is on and the second light source 112 is turned on; and if the second control signal DRV2 is in the second state (e.g., at a low level), then the second switch Q2 is off and the second light source 112 is turned off.

At time $t_C$, which is later than time $t_R$, the logic unit 310 outputs a clamp signal CLAMP in a first state (e.g., at a high level) to the power supply unit 306, causing the power supply unit 306 to clamp the voltage at the switch monitoring terminal VDD to a second voltage V2, to enable components associated with a dimming function in the controller 110 of FIG. 2 (e.g., the current detection unit 210, the error amplifier 208, the comparator 206, the sawtooth wave signal generating unit 204, etc.) to turn on the light source module 130. The first voltage V1 is greater than the second voltage V2. In other words, when the power switch 104 is turned on, the power supply unit 306 increases the voltage at the switch monitoring terminal VDD to the first voltage V1 to enable a write operation to the memory module 308, and then clamps (decreases) the voltage at the switch monitoring terminal VDD to the second voltage V2. The second voltage V2 is a voltage that can enable the components associated with the dimming function in the controller 110 to operate normally to turn on the light source module 130. When turned on, the light source module 130 can have different modes according to the state of the first control signal DRV1 and the second control signal DRV2. The state of the first control signal DRV1 and the second control signal DRV2 depend on the data read by the reading and writing unit 304 from the memory module 308.

Figure 4:
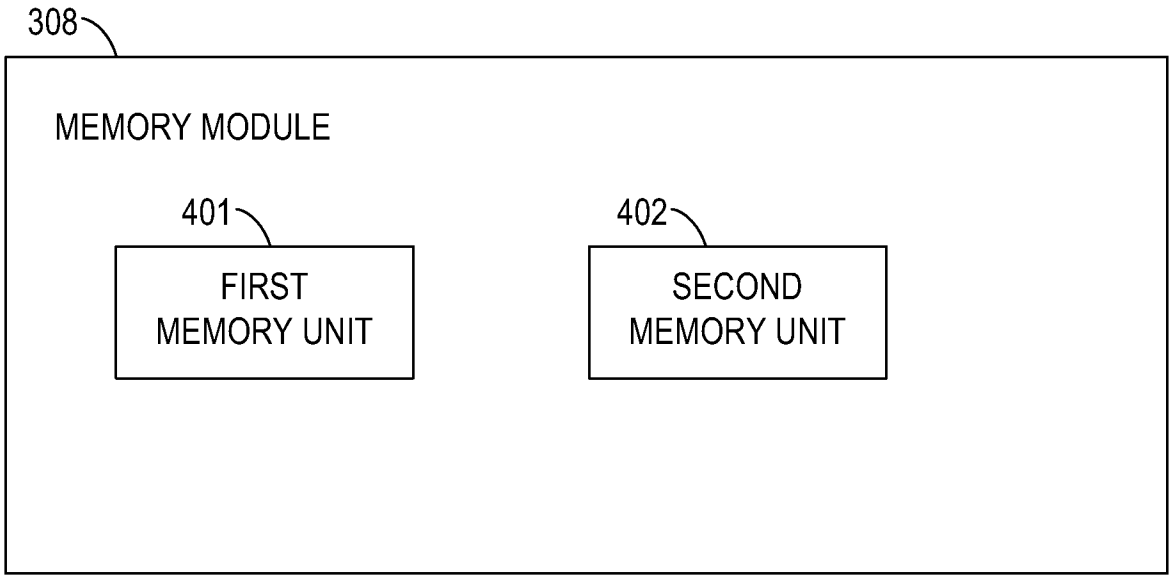
FIG. 4 shows a memory module, in accordance with one embodiment of the present invention.

FIG. 4 shows a memory module 308 in accordance with one embodiment of the present invention. In the embodiment of FIG. 4, the memory module 308 includes a first memory unit 401 and a second memory unit 402, which are operable for storing the count value from the counter 312. The two memory units 401 and 402 can store one bit of data, respectively. In one embodiment, if the reading and writing unit 304 reads data "00" from the memory module 308, then the first control signal DRV1 and the second control signal DRV2 are generated to turn on the first switch Q1 and turn off the second switch Q2, and thus the mode of the light source module 130 is mode A. If the reading and writing unit 304 reads data "01" from the memory module 308, then the first control signal DRV1 and the second control signal DRV2 are generated to turn on the first switch Q1 and turn on the second switch Q2, and thus the mode of the light source module 130 is mode B. If the reading and writing unit 304 reads data "10" from the memory module 308, then the first control signal DRV1 and the second control signal DRV2 are generated to turn off the first switch Q1 and turn on the second switch Q2, and thus the mode of the light source module 130 is mode C.

Figure 5:
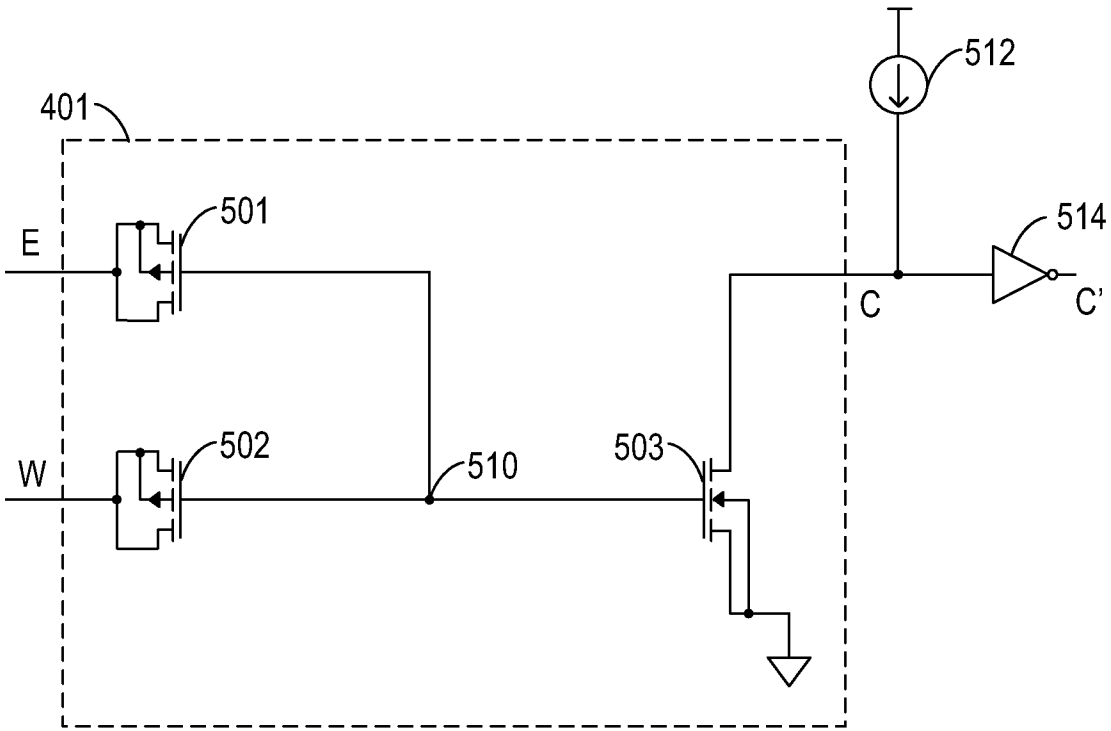
FIG. 5 shows a memory unit, in accordance with one embodiment of the present invention.

FIG. 5 shows a memory unit 401 in accordance with one embodiment of the present invention. In an embodiment, the structure of the second memory unit 402 is the same as that of the first memory unit 401. The first memory unit 401 includes a P-type metal-oxide semiconductor capacitor (MOS capacitor) 501, a P-type MOS capacitor 502 and an N-type metal-oxide semiconductor field effect transistor (NMOSFET) 503. In one embodiment, the capacitance of the first MOS capacitor 501 is greater than the capacitance of the second MOS capacitor 502. The gate of the first MOS capacitor 501, the gate of the second MOS capacitor 502 and the gate of the NMOSFET 503 are connected together. The area of the first MOS capacitor 501 is greater than the area of the second MOS capacitor 502. In one embodiment, the area of the first MOS capacitor 501 is much greater than (e.g., more than two times) the sum of the area of the second MOS capacitor 502 and the area of the gate of the NMOSFET 503. In another embodiment, the area of the first MOS capacitor 501 is at least twice of the sum of the area of the second MOS capacitor 502 and the area of the gate of the NMOSFET 503. The substrate, the source and the drain of the first MOS capacitor 501 are connected together to act as one electrode plate of the first MOS capacitor 501, labeled as the E terminal in FIG. 5. The gate of the first MOS capacitor 501 acts as the other plate of the first MOS capacitor 501. The substrate, the source and the drain of the second MOS capacitor 502 are connected together to act as one electrode plate of the second MOS capacitor 502, labeled as the W terminal in FIG. 5. The gate of the second MOS capacitor 502 acts as the other plate of the second MOS capacitor 502.

In one embodiment, to write to the memory unit 401 (e.g., write a logical "0"), the reading and writing unit 304 applies a voltage difference greater than the write threshold $V_{W\text{-}TH}$ between the E terminal and the W terminal. For example, the reading and writing unit 304 applies a high voltage on the E terminal and causes the W terminal to be grounded, and the voltage difference $V_{EW}$ between the E terminal and the W terminal is greater than the write threshold $V_{W\text{-}TH}$. Because the area of the first MOS capacitor 501 is greater than the area of the second MOS capacitor 502, and because the capacitance of the first MOS capacitor 501 is much greater than the capacitance of the second MOS capacitor 502, the voltage of the node 510 between the gate of the first MOS capacitor 501 and the gate of the second MOS capacitor 502 is relatively high. As a result, electrons flow into the node 510 and are stored at the node 510. Thus, even if the voltage difference between the E terminal and the W terminal is removed, the NMOSFET 503 remains in a high threshold state because the node 510 stores electrons having negative charges. In another embodiment, the reading and writing unit 304 applies a same voltage at both the E terminal and the W terminal, and the difference between that voltage and the source voltage of the NMOSFET 503 is greater than the write threshold $V_{W\text{-}TH}$. As a result, the voltage of the node 510 is relatively high, and electrons flow into the node 510 and are stored at the node 510. Thus, even if the voltage at the E terminal and at the W terminal is removed, the NMOSFET 503 remains in a high threshold state because the node 510 stores electrons having negative charges.

In one embodiment, to write to the memory unit 401 (e.g., write a logical "1"), the reading and writing unit 304 applies a high voltage on the W terminal and causes the E terminal to be grounded, and the voltage difference $V_{WE}$ between the W terminal and the E terminal is greater than the write threshold $V_{W\text{-}TH}$. Because the area of the first MOS capacitor 501 is greater than the area of the second MOS capacitor 502, and because the capacitance of the first MOS capacitor 501 is greater than the capacitance of the second MOS capacitor 502, the voltage of the node 510 between the gate of the first MOS capacitor 501 and the gate of the second MOS capacitor 502 is relatively low. As a result, a tunnel current is generated at the gate of the second MOS capacitor 502 and electrons flow from the node 510 to the W terminal, leaving holes having positive charges at the node 510. Thus, even if the voltage difference between the W terminal and the E terminal is removed, the NMOSFET 503 remains in a low threshold state because the node 510 stores positive charges.

Even if the system is out of power for a long time, the structure of the memory unit 401 described above enables the memory unit 401 to maintain its state after the write operation.

To read the data stored in the memory unit 401, a current source 512 is connected to the drain of the NMOSFET 503 (the connection point is labeled as C in FIG. 5), and a voltage that is between a turn-on voltage of the high threshold state and a turn-on voltage of the low threshold state is applied at both the E terminal and the W terminal. If the NMOSFET 503 is in the high threshold state, then the NMOSFET 503 is off. The voltage of the node C is pulled to a high level by the current source 512, and the state of output terminal C' of an inverter 514 coupled to the node C is at a low level. That is, the output terminal C' of the inverter 514 outputs a logical "0". If the NMOSFET 503 is in a low threshold state, then the NMOSFET 503 is on. The voltage of the node C is at the low level, and the state of the output terminal C' of the inverter 514 coupled to the node C is at a high level. That is, the output terminal C' of the inverter 514 outputs a logical "1".

As described above, in one embodiment, when the voltage difference $V_{EW}$ is greater than the write threshold $V_{W\text{-}TH}$, a logical "0" is written to the memory unit 401. In another embodiment, when the voltage at the E terminal and the voltage at the W terminal are the same and the difference between that voltage and the source voltage of the NMOSFET 503 is greater than the write threshold $V_{W\text{-}TH}$, a logical "0" is written to the memory unit 401. When the voltage difference $V_{WE}$ is greater than the write threshold $V_{W\text{-}TH}$, a logical "1" is written to the memory unit 401. The data stored in the memory unit 401 can be read from the node C via the inverter 514.

Figure 6:
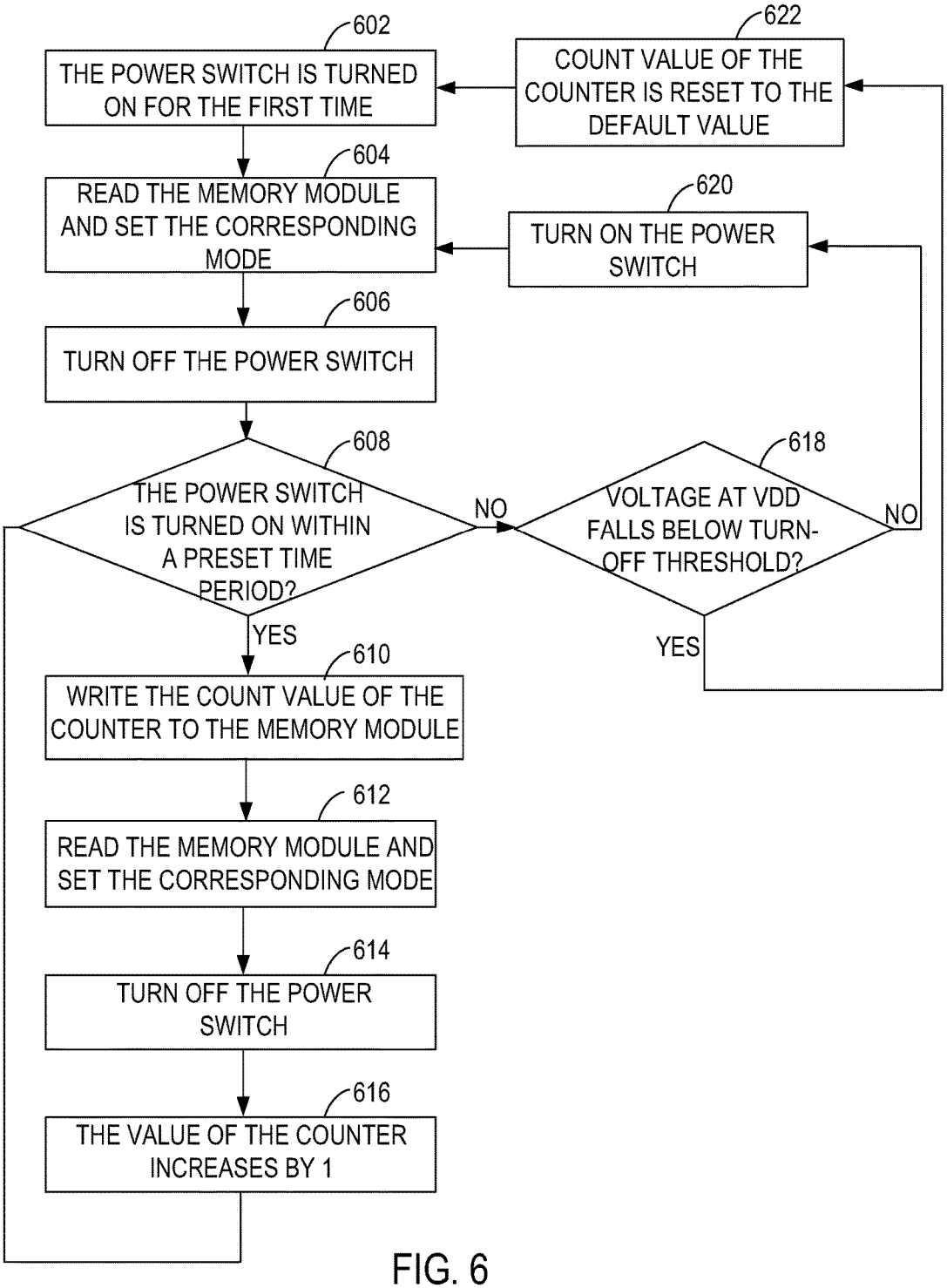
FIG. 6 shows a flowchart illustrating operation of a light source driving circuit, in accordance with one embodiment of the present invention.

FIG. 6 shows a flowchart illustrating operation of the light source driving circuit 100, in accordance with one embodiment of the present invention. FIG. 6 is described in combination with FIGS. 1-3.

In step 602, the power switch 104 is turned on for the first time. In step 604, the reading and writing unit 304 reads the data stored in the memory module 308 and generates a first control signal DRV1 and a second control signal DRV2 accordingly, to place the light source module 130 in a corresponding mode (e.g., mode A, B or C). In step 606, the power switch 104 is turned off. In step 608, a determination is made as to whether the power switch 104 is turned on within a preset time period. If the power switch 104 is turned on within the preset time period, then in step 610, the reading and writing unit 304 writes a count value of the counter 312 to the memory module 308. In step 612, the reading and writing unit 304 reads the data stored in the memory module 308 and places the light source module 130 in the corresponding mode. In step 614, the power switch 614 is turned off. In step 616, the count value of the count 312 increases by one and the flowchart goes to step 608.

Returning to step 608, if the power switch 104 is not turned on within the preset time period after being turned off, then the flowchart proceeds to step 618 to determine whether the voltage at the switch monitoring terminal VDD decreases to a turn-off threshold. If not, then the flowchart proceeds to step 620, where the power switch 314 is turned on. Then, the flowchart further goes to step 604. Otherwise, the flowchart proceeds to step 622, and the count value of the counter 312 is reset to the default value (e.g., zero). Then the flowchart returns to step 602.

Figure 7:
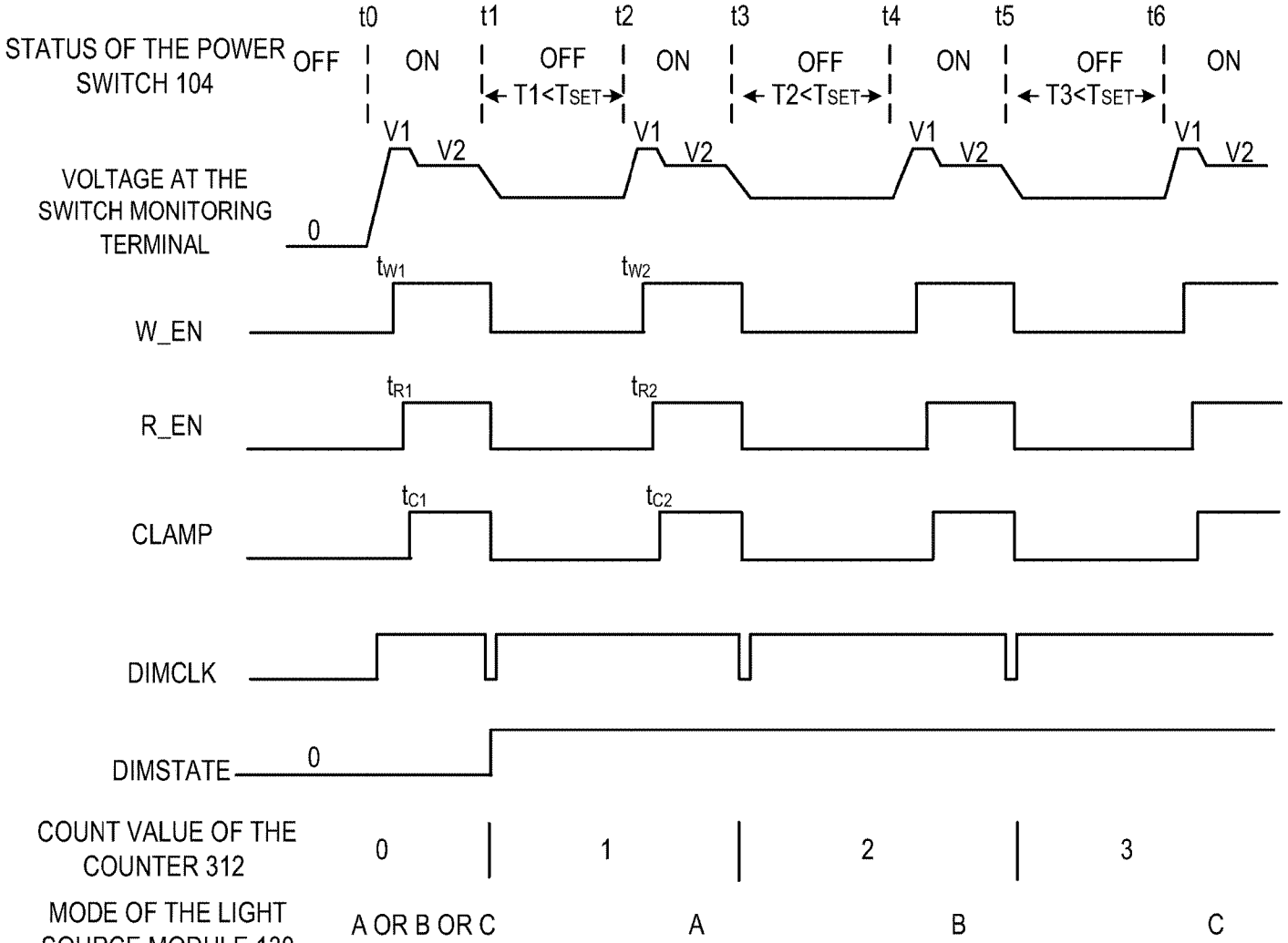
FIG. 7 shows a diagram illustrating operation of a light source driving circuit, in accordance with one embodiment of the present invention.

FIG. 7 shows a diagram illustrating operation of the light source driving circuit 100, in accordance with one embodiment of the present invention. FIG. 7 is described in combination with FIGS. 1-3 and FIG. 6. FIG. 7 shows the state of the power switch 104, the voltage at the switch monitoring terminal VDD of the controller 110, the write enable signal W_EN, the read enable signal R_EN, the clamp signal CLAMP, the trigger signal DIMCLK, the regulating signal DIMSTATE, the count value of the counter 312 and the state of the light source module 130. In the example of FIG. 7, the power switch 104 is turned on at time $t_0$, turned off at time $t_1$, turned on at time $t_2$, turned off at time $t_3$, turned on at time $t_4$, turned off at time $t_5$, and turned on at time $t_6$. A time interval T1 between time $t_1$ and time $t_2$, a time interval T2 between time $t_3$ and time $t_4$, and a time interval T3 between time $t_5$ and time $t_6$ are all less than a preset time period $T_{SET}$.

When the switch power 104 is turned on at time to, the voltage at the switch monitoring terminal VDD increases to V1 and the power supply unit 306 provides a voltage greater than the write threshold $V_{W\text{-}TH}$ to enable the reading and writing unit 304 to write to the memory module 308. Because the voltage at the switch monitoring terminal VDD increases to the first voltage V1, the logic unit 310 outputs a write enable signal W_EN in a first state (e.g., at a high level) at time $t_{W1}$, which is later than time $t_0$. At that time, the regulating signal DIMSTATE is in an initial state (e.g., at a low level), so the reading and writing unit 304 does not write to the memory module 308. At time $t_{R1}$, which is later than time $t_{W1}$, the logic unit 310 outputs the read enable signal R_EN in a first state (e.g., at a high level), and the reading and writing unit 304 reads the data from the memory module 308 to generate the first control signal DRV1 and the second control signal DRV2. At time $t_{C1}$, which is later than the time $t_{R1}$, the logic unit 310 outputs the clamp signal CLAMP in the first state (e.g., at a high level) to the power supply unit 306, which clamps the voltage at the switch monitoring terminal VDD to the second voltage V2 to enable the components associated with the dimming function in the controller 110 (e.g., the current detection unit 210, the error amplifier 208, the comparator 206, the sawtooth wave signal generating unit 204, etc., of FIG. 2) to turn on the light source module 130. The first voltage V1 is greater than the second voltage V2. In other words, when the power switch 104 is on, the power supply unit 306 first allows the voltage at the switch monitoring terminal VDD to increase to the first voltage V1 to enable a write operation to the memory module 308, and then clamps (decreases) the voltage at the switch monitoring terminal VDD to the second voltage V2. The second voltage V2 is a voltage that enables the components associated with the dimming function in the controller 110 to operate normally to turn on the light source module 130. After the light source 130 is turned on at time to, the mode of the light source module 130 can be mode A or mode B or mode C, depending on the value of the data read from the memory module 308 by the reading and writing unit 304.

When the switch power 104 is turned off at time $t_1$, the voltage at the switch monitoring terminal VDD decreases. A negative pulse appears in the trigger signal DIMCLK, which causes the state of the regulating signal DIMSTATE to change to a first state (e.g., a high level) and causes the count value of the counter 312 to increase by one, for example, changing from the default value zero to one. States of the write enable signal W_EN, the read enable signal R_EN and the clamp signal CLAMP all change to a second state (e.g., a low level).

The switch power 104 is turned on for the second time at time $t_2$, and the voltage at the switch monitoring terminal VDD increases to V1. The power supply unit 306 provides a voltage greater than the write threshold $V_{W\text{-}TH}$, which enables the reading and writing unit 304 to write to the memory module 308. Because the voltage of the switch monitoring terminal VDD increases to the first voltage V1, the logic unit 310 outputs a write enable signal W_EN in a first state (e.g., a high level) at time $t_{W2}$, which is later than time $t_2$. At that time, the regulating signal DIMSTATE is in the first state (e.g., a high level), so the reading and writing unit 304 writes the count value (e.g., one) of the counter 312 to the memory module 308 and stores it in binary format (e.g., as "01") in the memory module 308. At time $t_{R2}$, which is later than time $t_{W2}$, the logic unit 310 outputs the read enable signal R_EN in the first state (e.g., a high level), and the reading and writing unit 304 reads the data "01" from the memory module 308 to generate the first control signal DRV1 and the second control signal DRV2. At time $t_{C2}$, which is later than time $t_{R2}$, the logic unit 310 outputs the clamp signal CLAMP in the first state (e.g., a high level) to the power supply unit 306, which clamps the voltage at the switch monitoring terminal VDD to the second voltage V2 to enable the components associated with the dimming function in the controller 110 to turn on the light source module 130. According to the data (e.g., "01") read from the memory module 308, the light source module 130 is set to mode A after it is turned on.

The switch power 104 is turned off at time $t_3$ and at time $t_5$, and at each of those times the count value of the counter 312 increases by one in response to the trigger signal DIMCLK. At time $t_3$, the count value is two, which is stored in the memory module 308 as binary "10", and at time $t_5$, the count value is three, which is stored in the memory module 308 as binary "11". Therefore, when the power switch 104 is turned on at time $t_4$ and time $t_6$, the mode of the light source module 130 is mode B and mode C, respectively. When the power switch 104 is turned off after time $t_6$, the count value stored in the memory module 308 will be set to binary "00", and the sequence shown in FIG. 7 can begin again (that is, if the power switch 104 is turned on again after being turned off after time $t_6$, then the sequence of events starting at time to may be repeated).

Figure 8:
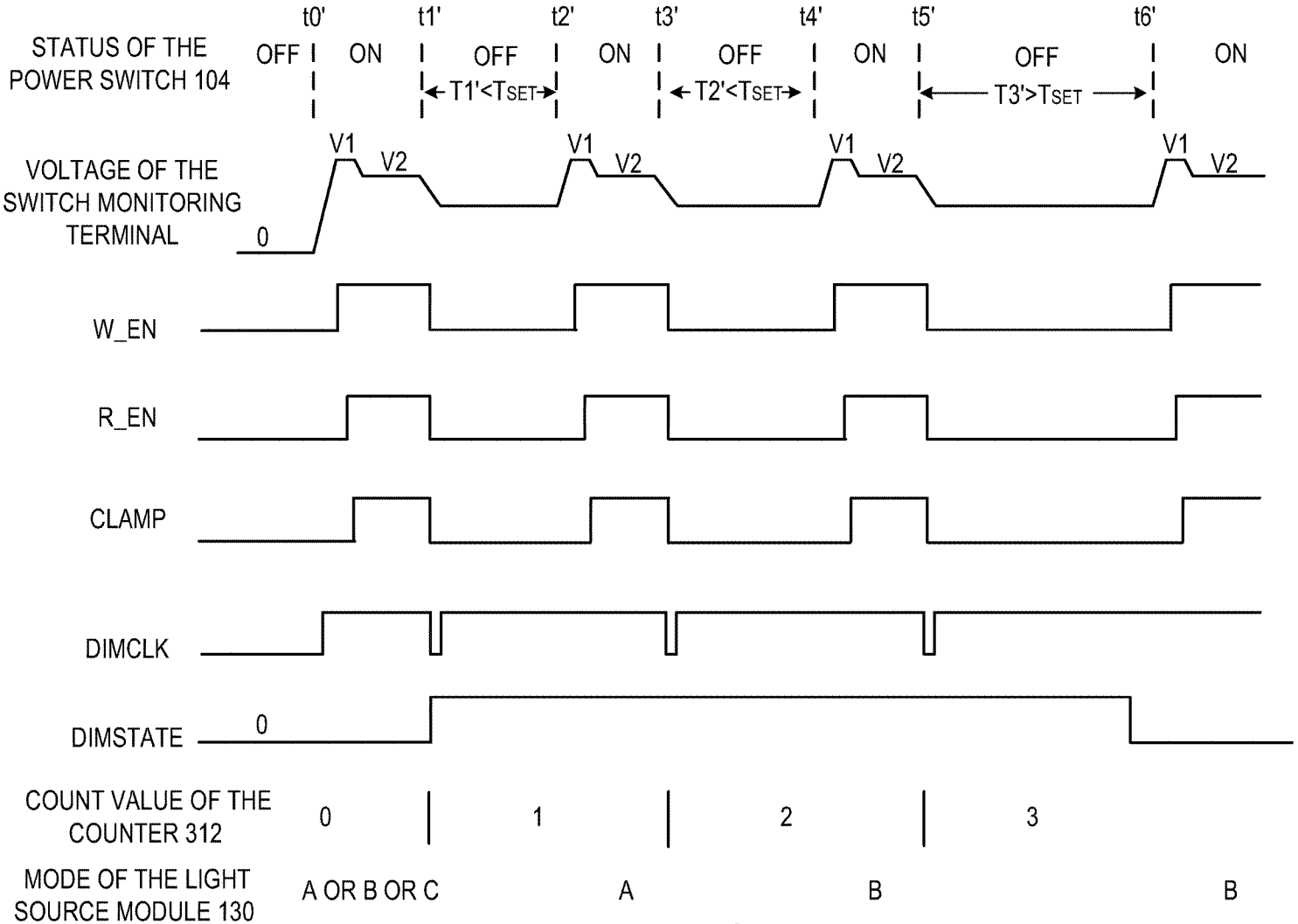
FIG. 8 shows a diagram illustrating operation of a light source driving circuit, in accordance with one embodiment of the present invention.

FIG. 8 shows a diagram illustrating operation of the light source driving circuit 100, in accordance with one embodiment of the present invention. FIG. 8 is described in combination with FIGS. 1-3 and FIG. 6. The power switch 104 is turned on at time $t_0'$, turned off at time $t_1'$, turned on at time $t_2'$, turned off at time $t_3'$, turned on at time $t_4'$, turned off at time $t_5'$, and turned on at time $t_6'$. A time interval T1' between time $t_1'$ and time $t_2'$, and a time interval T2' between time $t_3'$ and time $t_4'$, are both less than the preset time period $T_{SET}$. The operation of the light source driving circuit from time $t_0'$ to time $t_5'$ is similar to the operation from time $t_0$ to time $t_5$ described in FIG. 7. However, in the example of FIG. 8, a time interval T3' between time $t_5'$ and time $t_6'$ is greater than the preset time period $T_{SET}$. When the preset time period $T_{SET}$ expires, the regulating signal DIMSTATE is reset to the initial state (e.g., at a low level). Accordingly, when the power switch 104 is turned on at the time $t_6'$, the reading and writing unit 304 does not write to the memory module 308. The data stored in the memory module 308 is a count value of two, which is written into the memory module 308 after the power switch 104 is turned on at time $t_4'$. The count value is read by the reading and writing unit 304. Therefore, when the power switch 104 is turned on at the time $t_6'$ and the light source module 130 is turned on, the mode of the light source module 130 still remains at mode B. Also, referring to step 618 of FIG. 6, if the time interval T3' is long enough to allow the voltage at the switch monitoring terminal VDD to decrease below the turn-off threshold, then the count value of the counter 312 is reset to the default value zero.

Figure 9:
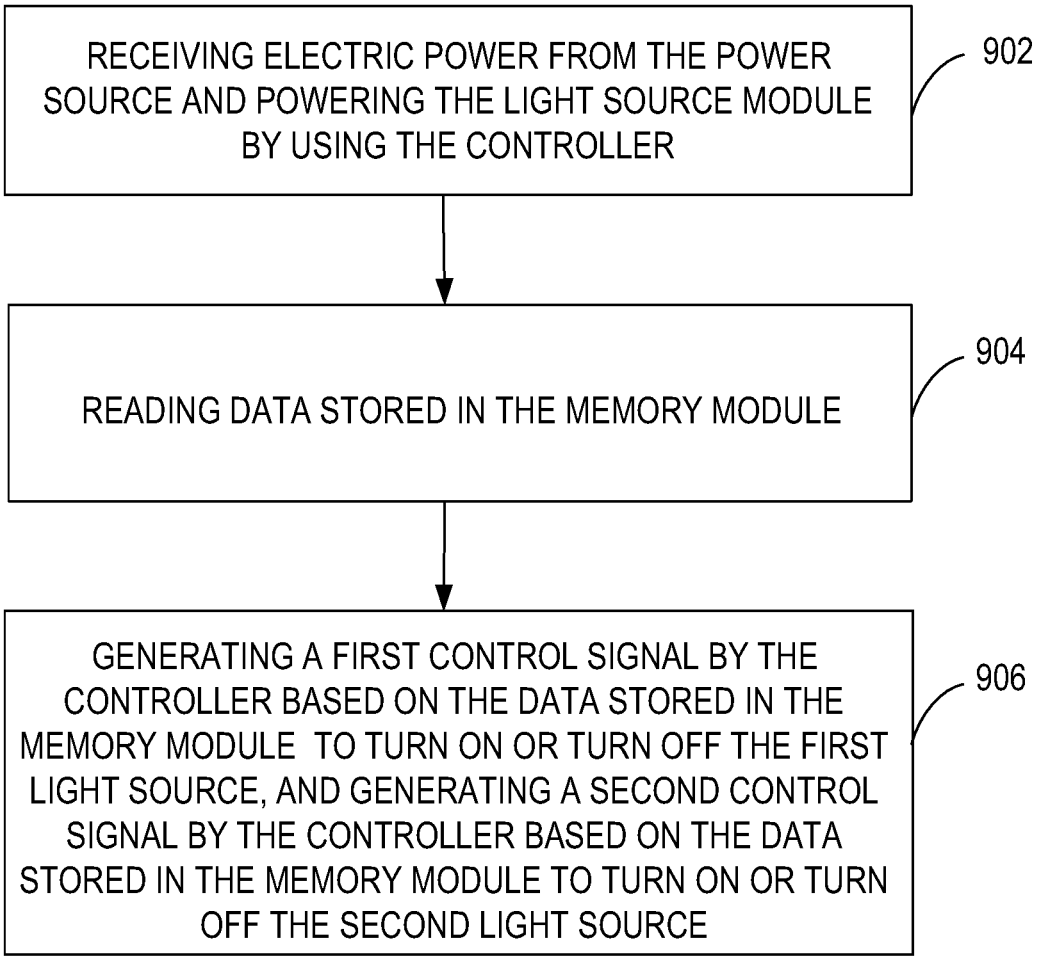
FIG. 9 shows a flowchart of a method for controlling power of a light source module, in accordance with one embodiment of the present invention.

FIG. 9 shows a flowchart of a method for controlling power of the light source module 130, in accordance with one embodiment of the present invention. The light source module includes a first light source and a second light source. FIG. 9 is described in combination with FIGS. 1-3.

In step 902, electric power is received from the power source 102 and powers the light source module 130 using the controller 110.

In step 904, data stored in the memory module 308 is read using the reading and writing unit 304.

In step 906, a first control signal is generated based on the data stored in the memory module 308 to turn on or turn off the first light source 111, and a second control signal is generated based on the data stored in the memory module 308 to turn on or turn off the second light source 112 by the controller 110.

As described above, embodiments according to the present invention disclose a controller for controlling a light source module, a light source driving circuit and a method for controlling a light source module. The present invention can adjust the mode of the light source module with a power switch to adjust the color or brightness of the light source module. Because an additional dimming device is not needed and is eliminated, the cost is reduced. In addition, the mode of the light source module can be memorized by the memory module integrated in the controller. That is, even if the system is out of power for a long time, when the power switch is turned on again, the controller can read the data stored in the memory module directly and enable the mode of the light source module instantly set to the mode that the user used last time according to the data. While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A controller operable for controlling a light source module, said controller comprising:

a current input terminal, coupled to a power source through a rectifier, operable for receiving electric power from said power source;

a switch monitoring terminal, coupled to a power switch, operable for receiving a switch monitoring signal indicating the on/off state of said power switch, wherein said power switch is coupled between said rectifier and said power source;

a first control terminal, operable for turning on a first light source in said light source module and operable for turning off said first light source, based on said switch monitoring signal;

a second control terminal, operable for turning on a second light source in said light source module and operable for turning off said second light source, based on said switch monitoring signal; and a current monitoring terminal, operable for monitoring a current flowing through said first light source and a current flowing through said second light source.

2. The controller of claim 1, wherein said controller further comprises:

a first switch coupled to said first control terminal;

a second switch coupled to said second control terminal;

a third switch coupled to said current input terminal; and a logic control module, coupled to said first switch, said second switch and said third switch, wherein said logic control module is operable for: regulating a total current of said light source module by controlling said third switch, turning on said first light source by controlling said first switch and turning off said first light source by controlling said first switch, and turning on said second light source by controlling said second switch and turning off said second light source by controlling said second switch.

3. The controller of claim 2, wherein a current flows from said current input terminal through said third switch, said current monitoring terminal and an inductor to ground when said third switch is on.

4. The controller of claim 3, wherein a current flows through said inductor, said first light source, said first control terminal, said first switch and said current monitoring terminal when said third switch is off and said first switch is on; and wherein a current flows through said inductor, said second light source, said second control terminal, said second switch and said current monitoring terminal when said third switch is off and said second switch is on.

5. The controller of claim 2, wherein said logic control module comprises a memory module, wherein said logic control module is operable for generating a first control signal, said first control signal for turning on said first light source and for turning off said first light source, based on data stored in said memory module; wherein said logic control module is further operable for generating a second control signal, said second control signal for turning on said second light source and for turning off said second light source, based on said data stored in said memory module.

6. The controller of claim 5, wherein said memory module comprises:

a first metal-oxide semiconductor capacitor (MOS capacitor);

a second MOS capacitor; and a metal-oxide semiconductor field effect transistor (MOSFET), wherein the gate of said first MOS capacitor, the gate of said second MOS capacitor and the gate of said MOSFET are connected together; wherein the area of said first MOS capacitor is greater than the area of said second MOS capacitor; wherein the substrate, the source and the drain of said first MOS capacitor are connected together; and wherein the substrate, the source and the drain of said second MOS capacitor are connected together.

7. The controller of claim 5, wherein said logic control module further comprises:

a trigger monitoring unit, operable for generating a trigger signal based on said switch monitoring signal;

a logic unit, operable for generating a read enable signal and a write enable signal based on said switch monitoring signal, and also operable for generating a regulating signal based on said trigger signal; and a reading and writing unit, operable for writing to said memory module based on said write enable signal and said regulating signal, and also operable for reading said memory module based on said read enable signal.

8. The controller of claim 7, wherein said logic unit comprises:

a counter, operable for storing a count value and for updating said count value based on said trigger signal, wherein said reading and writing unit writes said count value to said memory module based on said write enable signal and said regulating signal.

9. The controller of claim 8, wherein if said switch monitoring signal indicates that said power switch is turned on again within a preset time period after being turned off, then said logic unit generates said write enable signal and said regulating signal, and writes said count value to said memory module using said reading and writing unit.

10. The controller of claim 7, wherein said logic control module further comprises:

a power supply unit, operable for providing a first voltage to enable said reading and writing unit to write to said memory module, and also operable for clamping a voltage at said switch monitoring terminal to a second voltage to turn on said light source module, wherein said first voltage is greater than said second voltage.

11. A light source driving circuit, comprising:

a light source module, comprising a first light source and a second light source; and a controller, coupled to said light source module, operable for receiving electric power from a power source through a rectifier to power said light source module, said controller comprising a memory module;

wherein said controller is operable for generating a first control signal for turning on said first light source and for turning off said first light source, based on data stored in said memory module; and wherein said controller is further operable for generating a second control signal for turning on said second light source and for turning off said second light source, based on said data stored in said memory module.

12. The light source driving circuit of claim 11, wherein said memory module comprises:

a first metal-oxide semiconductor capacitor (MOS capacitor);

a second MOS capacitor; and a metal-oxide semiconductor field effect transistor (MOSFET), wherein the gate of said first MOS capacitor, the gate of said second MOS capacitor and the gate of said MOSFET are connected together; wherein the area of said first MOS capacitor is greater than the area of said second MOS capacitor; wherein the substrate, the source and the drain of said first MOS capacitor are connected together; and wherein the substrate, the source and the drain of said second MOS capacitor are connected together.

13. The light source driving circuit of claim 11, wherein said controller comprises:

a logic control module, operable for regulating a total current of said light source module by controlling a third switch and also operable for updating said data stored in said memory module based on a switch monitoring signal, wherein said first control signal controls a first switch coupled to said first light source, wherein said second control signal controls a second switch coupled to said second light source, and wherein said switch monitoring signal indicates an on/off state of a power switch coupled between said power source and said rectifier.

14. The light source driving circuit of claim 13, further comprising:

an inductor, coupled between said controller and said light source module;

wherein a current flows through said third switch and said inductor to ground when said third switch is on, wherein a current flows through said inductor, said first light source and said first switch when said third switch is off and said first switch is on, and wherein a current flows through said inductor, said second light source and said second switch when said third switch is off and said second switch is on.

15. The light source driving circuit of claim 13, wherein said logic control module further comprises:

a trigger monitoring unit, operable for generating a trigger signal based on said switch monitoring signal;

a logic unit, operable for generating a read enable signal and a write enable signal based on said switch monitoring signal, and also operable for generating a regulating signal based on said trigger signal; and a reading and writing unit, operable for writing to said memory module based on said write enable signal and said regulating signal, and also operable for reading said memory module based on said read enable signal.

16. The light source driving circuit of claim 15, wherein said logic unit comprises:

a counter, operable for storing a count value and for updating said count value based on said trigger signal, wherein said reading and writing unit writes said count value to said memory module based on said write enable signal and said regulating signal.

17. The light source driving circuit of claim 15, wherein said logic control module further comprises:

a power supply unit, operable for providing a first voltage to enable said reading and writing unit to write to said memory module, and also operable for clamping a voltage at said switch monitoring terminal to a second voltage to turn on said light source module, wherein said controller receives said switch monitoring signal from said switch monitoring terminal, and wherein said first voltage is greater than said second voltage.

18. A method for controlling a light source module, wherein said light source module comprises a first light source and a second light source, said method comprising:

receiving electric power from a power source at a controller, to power said light source module;

reading data stored in a memory module;

generating a first control signal by said controller based on data stored in said memory module, said first control signal for turning on said first light source and for turning off said first light source; and generating a second control signal by said controller based on said data stored in said memory module, said second control signal for turning on said second light source and for turning off said second light source.

19. The method of claim 18, further comprising:

receiving a switch monitoring signal indicating an on/off state of a power switch, wherein said power switch is coupled between a power source and a rectifier;

generating a trigger signal based on said switch monitoring signal;

updating a count value of a counter based on said trigger signal; and writing said count value to said memory module if said switch monitoring signal indicates that said power switch is turned on again within a preset time period after being turned off.

20. The method of claim 19, further comprising:

increasing a voltage at said switch monitoring terminal to a first voltage to enable a write operation to said memory module; and decreasing said voltage at said switch monitoring terminal to a second voltage to turn on said light source module, wherein said first voltage is greater than said second voltage.

* * * * *